US005623811A

United States Patent [19]

Hirschek et al.

[11] Patent Number: 5,623,811

[45] Date of Patent: Apr. 29, 1997

[54] PROCESS AND DEVICE FOR PACKAGING AND SUPPLYING FIBER MATERIAL

[75] Inventors: Herwig Hirschek, Bobingen; Jürgen Lang, Gessertshausen, both of Germany

[73] Assignee: Firma Autefa Maschinenfabrik GmbH, Friedberg, Germany

[21] Appl. No.: 239,349

[22] Filed: May 6, 1994

[51] Int. Cl.[6] ..... B65B 1/20

[52] U.S. Cl. ..... 53/436; 53/527; 100/215; 100/229 A

[58] Field of Search ..... 100/215, 229 A, 100/240, 246; 53/121, 436, 523, 527, 529; 141/80, 390

[56] References Cited

U.S. PATENT DOCUMENTS

| | | | |
|---|---|---|---|
| 3,741,416 | 6/1973 | Bilbow | 53/436 |
| 3,808,766 | 5/1974 | Hutchinson | 53/436 |
| 4,044,525 | 8/1977 | Forsgren | 53/436 |
| 4,372,101 | 2/1983 | Fleissner | 52/527 |
| 4,572,065 | 2/1986 | Fishburne | 53/527 |
| 4,979,866 | 12/1990 | Croy | 100/215 |
| 5,046,304 | 9/1991 | Alameda et al. | 100/229 A |
| 5,074,101 | 12/1991 | Rewitzer | 100/215 |
| 5,203,261 | 4/1993 | Davis | 100/215 |

FOREIGN PATENT DOCUMENTS

| | | |
|---|---|---|
| 905107 | 1/1954 | Germany . |
| 1326246 | 8/1973 | United Kingdom . |

*Primary Examiner*—W. Donald Bray
*Attorney, Agent, or Firm*—McGlew and Tuttle

[57] ABSTRACT

The present invention pertains to a process and a device for packaging and supplying fiber material 5. In a multi-location fiber plant 1, the fiber material is filled into a closable freight container and is compacted in a filling station 2, and the freight container is subsequently shipped to a remote further processing station 3 with a transport vehicle 7. The fiber material 5 is filled into the freight container 4 as a collective load and without additional baling and hooping, and it is subjected to further processing from the freight container 4.

29 Claims, 13 Drawing Sheets

PROCESS AND DEVICE FOR PACKAGING AND SUPPLYING FIBER MATERIAL

FIELD OF THE INVENTION

The present invention pertains to a process and a device for packaging and supplying fiber material with and a process for packaging and supplying fiber material.

BACKGROUND OF THE INVENTION

It has been known that the fiber material is pressed by fiber manufacturers into manageable bales, and that the bales are also packaged with a film or the like and are secured with hoops. The bales are then transported to a processor for further processing. The bales must be freed from the packaging and the hoops there before the pressed fiber material can be subjected to further processing. This technique for packaging and supplying fiber material is expensive and is also associated with problems in terms of the disposal of the packaging and hoop materials.

SUMMARY AND OBJECTS OF THE INVENTION

It is an object of the present invention is to provide a less expensive process and a corresponding device, which are also associated with fewer problems in terms of disposal.

According to the present invention, the fiber material is not reduced to the form of bales, but it is immediately and directly filled into a closable freight container and is compacted. The fiber material is then shipped in the freight container and is subjected to further processing. The freight container represents a means of transportation and a reusable packaging for the fiber material. Additional reinforcements or packagings of the fiber material are unnecessary.

If the freight container is of a corresponding design, the fiber material can be processed immediately from the container with an unloading device in the further processing plant. The total expense that was previously necessary for preparing the bales is eliminated with the present invention.

Another advantage is the packaging and supplying of larger batches of fiber material. The freight container has a substantially larger volume than the bales usually used hitherto, so that the freight costs as well as the cost of loading and unloading also decrease substantially.

A number of different techniques, for which some exemplary embodiments will be schematically described in the specification, are available for filling the fiber material into the freight container and compacting it.

The fiber material can be compacted while it is being filled into the freight container. However, it is also possible to prepare, outside the freight container, a block of fibers, whose volume preferably corresponds to the capacity of the container, after which the block of fibers as a whole is introduced into the freight container. A similar procedure is also possible during the further processing, by unloading the fiber material as a block and then subjecting it to further processing, rather than removing it gradually from the freight container.

It is recommended that at least the external dimensions of the freight container be designed such that they correspond to the dimensions standardized for the usual freight traffic, which facilitates the transportation and the handling of the freight containers. The freight container is closable to guarantee safe transportation.

It is recommended that the freight container be adapted to the special loading and unloading technique by arranging, e.g., a wall element movably and by it being able to be used as a pressing plate. To fill and empty the freight container, the wall element is attached to a fitting press ram or another drive. The fiber material can then be pushed into and again out of the freight container with the wall element, and compaction of the fiber material can be performed. The drive is simply detached from the wall element in the end position, and the freight container is ready for shipping. Besides the simplified operation, the movable wall element also makes possible a better filling of the freight container.

It is recommended that a loading and positioning device, which makes possible the direct transfer of the freight container to a transport vehicle, e.g., a truck, or the taking over of the freight container from a transport vehicle, be provided at the filling station and/or at the further processing station. The loading and positioning device has suitable supports, which position the freight container in the intended position in the filling station and/or in the further processing station.

The fiber material is preferably filled into the freight container as a collective load and without additional baling and without hooping. The fiber material may be gradually removed from the open freight container with an unloading device and may be fed directly into a further processing device. Filling of the freight container is preferably accomplished with simultaneous compaction. The fiber material may also be compacted prior to being filled into the freight container. In the latter case, the fiber material is collected outside the freight container and is pressed into a shape corresponding to the interior space of the container. The shaped element is introduced as a block of fibers into the freight container.

In the situation wherein the fiber material is compacted as it is fed into the freight container, the fiber material may be compacted in a direction of pressing which extends at right angles to a direction of pushing the material into the freight container. A wall element of the freight container may be used for compacting the fiber material.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1A:
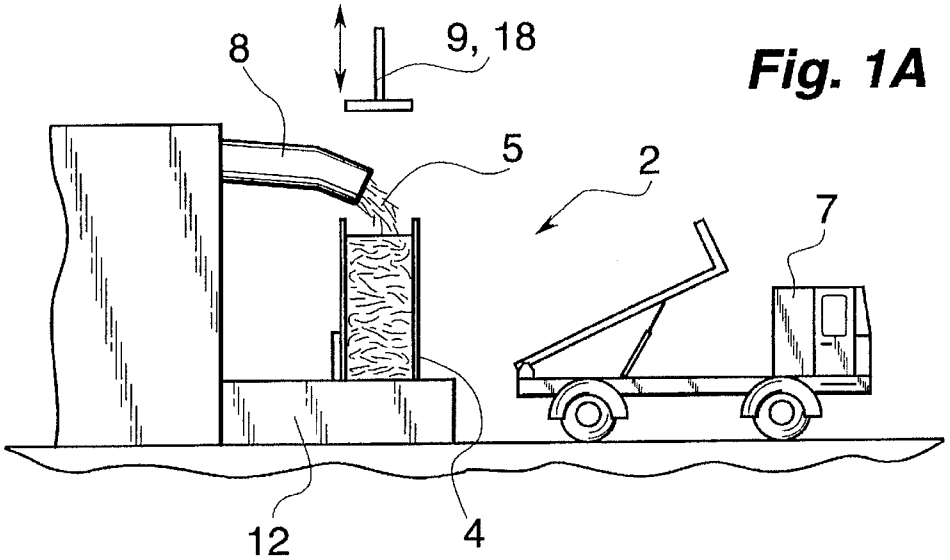
FIGS. 1A and 1B are a schematic view of a fiber plant with a filling station and with a further processing station, freight containers and transport vehicles.
Figure 1B:
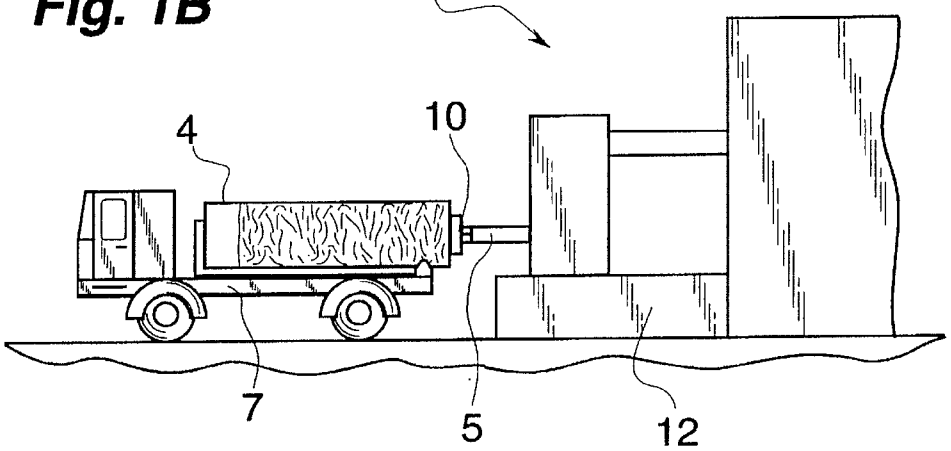

FIG. 1 shows a schematic view of a fiber plant, comprised of a filling station 2 and a further processing station 3 for fiber material 5, which is located at a different site. The filling station 2 is preferably located in a fiber-manufacturing plant, but it may also be located elsewhere. The further processing station 3 is located in a fiber-processing plant, e.g., a spinning mill or the like.

The fiber material 5 is filled into a freight container 4 in the filling station 2 and compacted prior to or during the filling process. The freight container 4 is closable for safe transportation, and is shipped after filling by means of a suitable transport vehicle 7, e.g., a truck in this case. The transport vehicle 7 may also be of any other desired design, e.g., a railroad car.

The transport vehicle 7 brings the filled freight container 4 to the further processing station 3, where the fiber material 5 is unloaded from the freight container 4 and is fed preferably directly into the further processing process. For example, an unloading device 10 is provided which removes the pressed fiber material by milling, or in another manner and delivers it via a blow line into a collection tank or mixing tank or another unit of a further processing station 11. The fiber material 5 may also be unloaded as a block into an intermediate storage facility and fed from there into the further processing process. The empty freight container 4 is returned to the filling station 2.

The freight container 4 preferably has a standard size usually for freight traffic, at least in terms of its external dimensions. It is designed, e.g., as a rectangular container with a length of 20 ft. or 40 ft. and with cross-sectional dimensions of ca. 2×2.5 m, and it has suitable fastening elements or supports for transport means, such as lifting unloaders, container cranes, loading ramps of trucks, railroad cars or the like.

The freight container 4 preferably, includes of steel plate and is able to withstand high compaction pressures. It may be designed as an open-top container (cf. FIG. 2), which makes possible loading from the top. A rigid cap or a tarpaulin may be used as the closure. As an alternative, the freight container 4 may also have a rigid, closed jacket, and be accessible through doors 23 only on the front side, from one side or from both sides. The doors 23 are present at least on one side, preferably even in the above-mentioned open-top containers. The doors 23 may be sliding doors or hinged doors.

Respective loading and positioning devices 12 for the freight container 4 are arranged at the filling station 2 and the further processing station 3. The loading and positioning devices 12 are used to transfer the freight container to the transport vehicle 7 and also to receive the freight container from the vehicle. In addition, they bring the freight container 4 into the working position at the filling station 2 or at the further processing station 3. The loading and positioning devices 12 have corresponding supports for the freight container 4 and are designed as, e.g., movable unloaders, sliding and pivoting board forms or in another suitable manner. They may also have essentially only positioning tasks, if the transport vehicle 7 has a self-unloading means for receiving or transferring the freight container 4, or if the freight container 4 remains on the transport vehicle 7 for loading and unloading (cf. FIG. 1).

The filling station 2 contains a filling device 8 and a compacting device 9, which will be described below in various exemplary embodiments. The filling device 8 may be connected to a fiber production line or even to an intermediate storage facility. Short staple fibers or long fibers, so-called tow, may be processed as the fiber material 5.

FIG. 1A shows the simplest embodiment of the filling station 2. The freight container 4 stands upright here and is opened on the front side located on the top. The fiber material 5 is filled into the freight container 4 from the top by means of the movable filling device 8, e.g., a cable layering apparatus for tow or a blowpipe. The compacting device 9 consists here of a vertically operating pressing device 18, which may be designed similarly to a baling press, e.g., as a hydraulic press. The fiber material 5 is cyclically filled into the freight container 4 by means of the filling device 8, and it is compacted by the pressing device 18 after withdrawal of the filling device 8. The next batch of the fiber material 5 is subsequently filled in and compacted. The doors 23 of the freight container 4 are finally closed, and the freight container 4 is transferred onto the transport vehicle 7.

Figure 2:
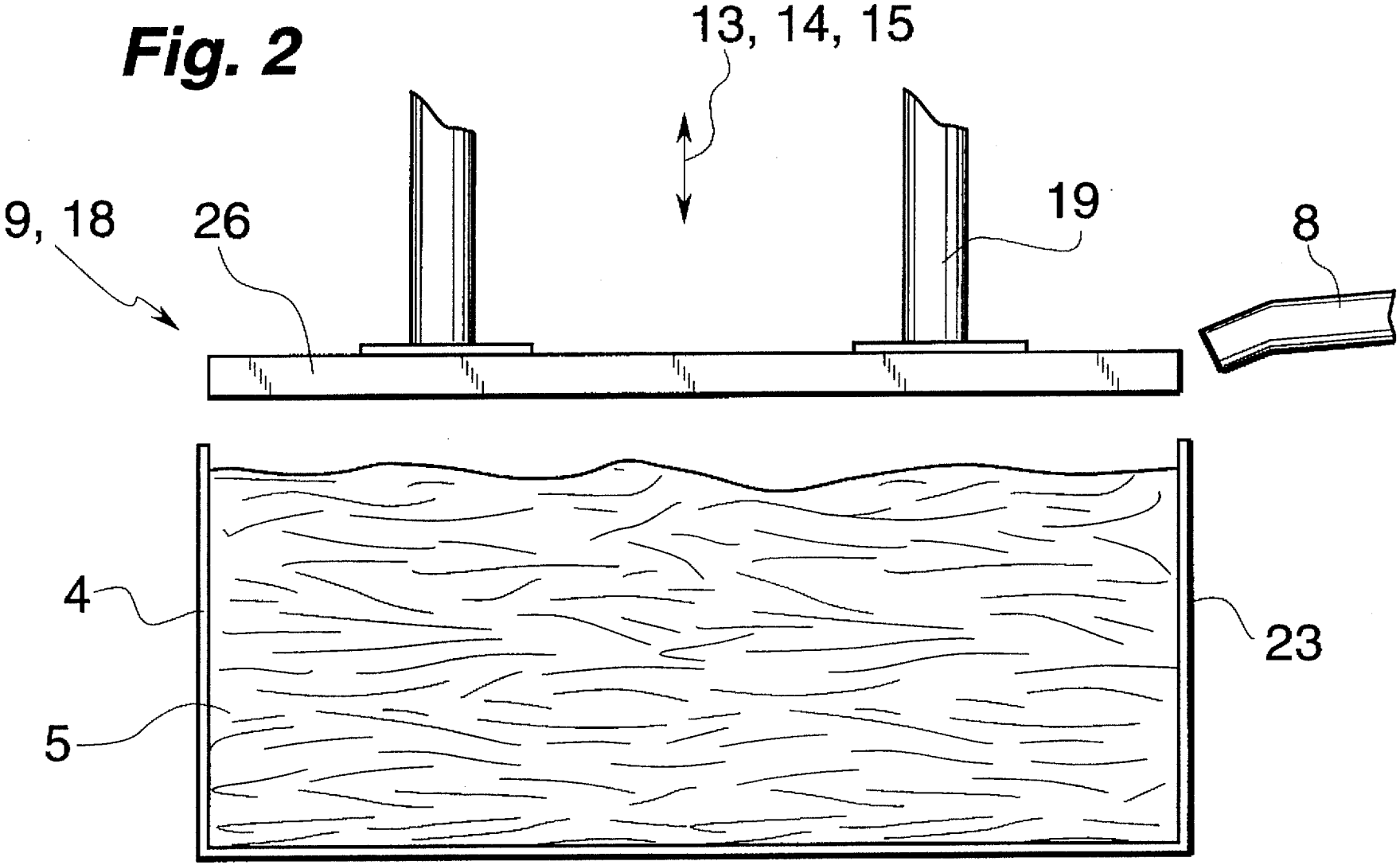
FIG. 2 is a side view illustrating the filling of an open-top freight container.

FIG. 2 shows a variant of filling with the horizontal freight container 4, a so-called open-top container. The direction of filling 13, the direction of pressing 14, and the direction of pushing in 15 of the fiber material 5 are made to be the same in this case as well, just as in the above-described exemplary embodiment shown in FIG. 1A. The pressing plate 26 may correspond to the size of the area of the freight container 4, and it is suspended, e.g., on two press rams 19. However, it may also be smaller and compact only partial batches of the fiber material 5 filled in, and the pressing device 18 and the freight container 4 are movable in relation to one another, which can be achieved, e.g., via the loading and positioning device 12. The filling device 8 is movable in this case as well.

Figure 3:
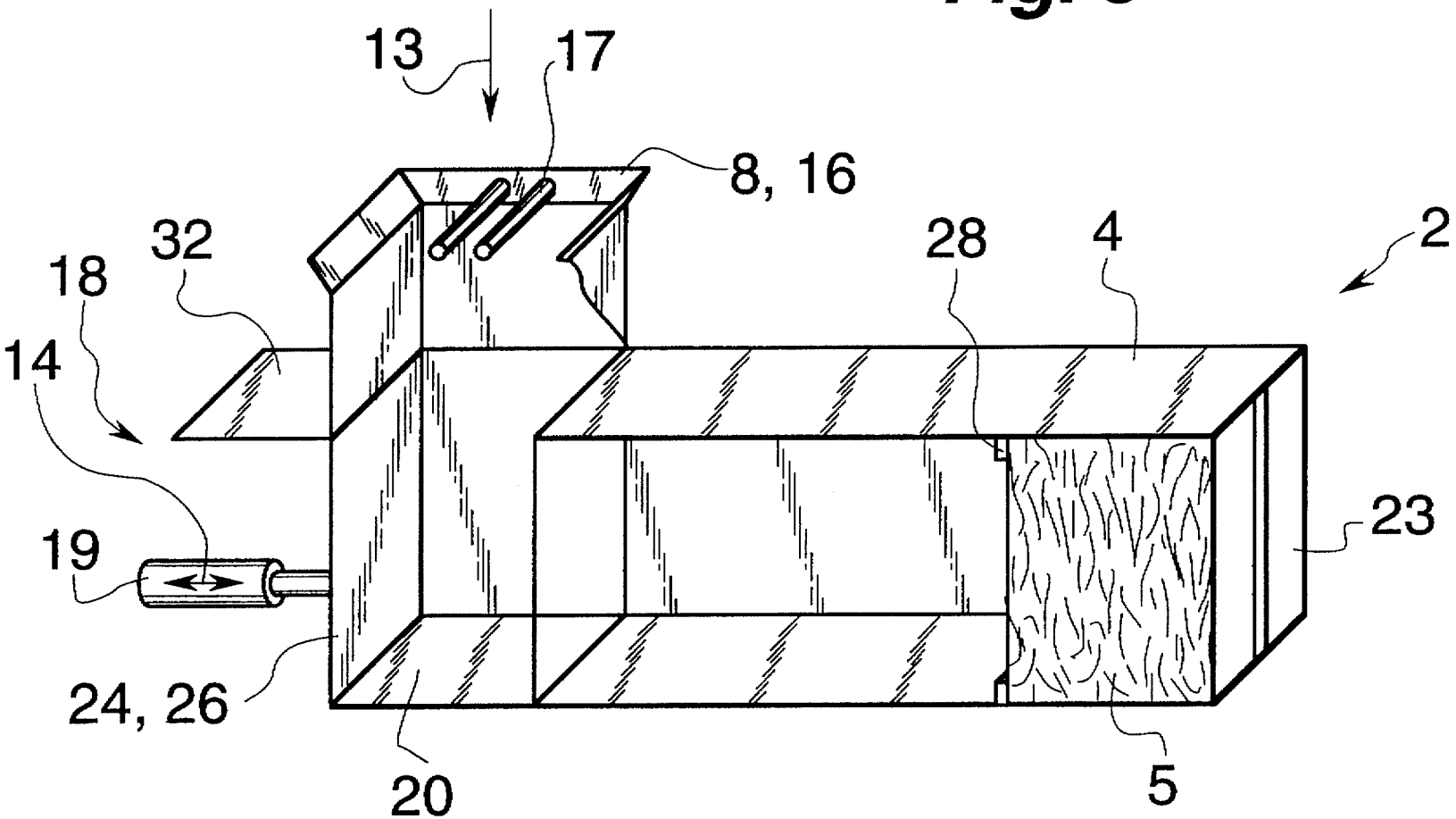
FIGS. 3 and 4 are views showing the filling of a freight container by front-side doors with two different embodiments of the compacting device.
Figure 4:
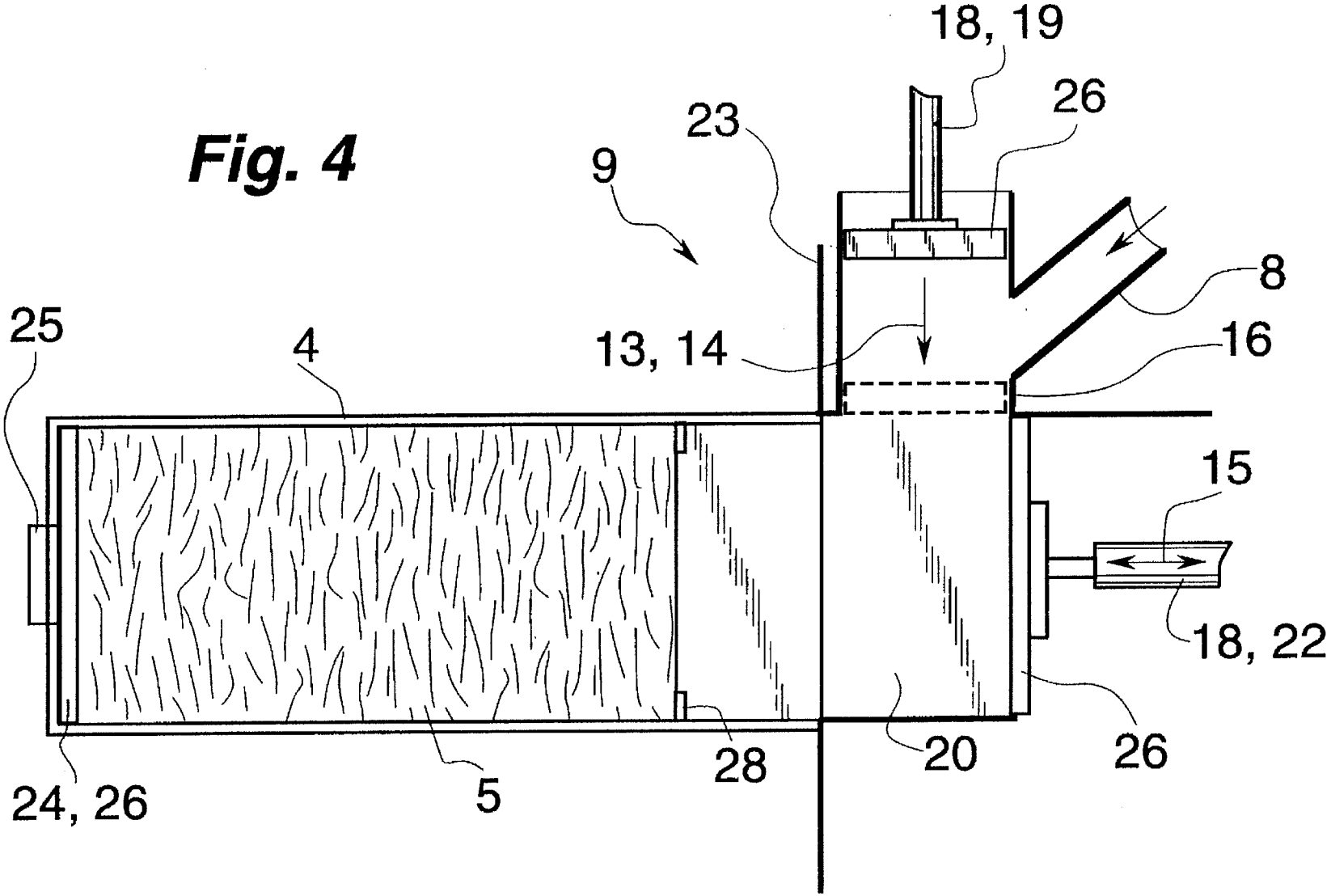

FIGS. 3 and 4 show two variants of the filling of the horizontal freight container 4 by the front-side doors 23. A front-side wall element 24 is mounted movably in the longitudinal direction of the freight container 4 and can be connected to the press ram 19 or another suitable drive via a suitable support 25 (cf. FIG. 5). The wall element 24 is used in this case as a pressing plate 26, with which the fiber material 5 can be pushed into the freight container 4 and also compacted. On the other hand, the wall element 24 can also be used again for unloading the freight container 4, which will be described in detail below in connection with FIGS. 10 and 11.

In the two embodiments according to FIGS. 3 and 4, the filling device 8 is arranged in front of the loading opening of the freight container 4 and is located above a filling and prepressing chamber 20. The filling device 8 has, e.g., a hopper 16 for receiving and bundling the stream of fibers being fed in this case. However, the fiber material 5 may also be precompacted by means of a prepressing device 17 in the area of the filling device 8 and be brought into the filling and prepressing chamber 20 or into the freight container 4 in this precompacted state.

In the exemplary embodiment according to FIG. 3, the filling and prepressing chamber 20 is filled from the top and is subsequently covered on the top by a slide 32. The wall element 24 is located on the rear side of the filling and prepressing chamber 20, and the wall element 24 is subsequently pushed forward by the press ram 19, while pushing the fiber material 5 from the filling and prepressing chamber 20 into the freight container 4. The batch is now pressed against the opposite, closed front side of the freight container 4 or against a partial batch filled in before. After withdrawal of the wall element 24 and of the slide 32, the filling and prepressing chamber 20 can again be filled with a new partial batch of the fiber material 5. When the freight container 4 is full, the wall element 24 is moved to the front opening of the freight container 4 and is locked with a suitable locking device not shown there. The freight container 4 is then closed on all sides and can be shipped.

In the exemplary embodiment according to FIG. 3, the direction of filling 13 and the direction of pressing 14 are at right angles to one another, and the direction of pressing 14 coincides with the direction of pushing in 15 of the fiber material into the freight container 4.

In the exemplary embodiment according to FIG. 4, the direction of filling 13 and the direction of pressing 14 are parallel to one another, and the directions are at right angles to the direction of pushing in 15. The fiber material is introduced into the filling and prepressing chamber 20 by the filling device 8 and the hopper 16, which is pulled up somewhat, and it is subsequently compacted with the vertically operating pressing device 18. The pressing plate is lowered during compaction until it is aligned flush with the upper inner surface of the freight container represented by broken lines 4.

The filling and prepressing chamber 20 is closed on the rear side by an additional, vertical pressing plate 26, which ensures the pushing in of the pressed partial batch into the freight container 4 by means of the press ram 19 or another drive. It is, in this sense, a conveying means 22 for the material prepressed in the transverse direction.

In FIG. 4, the fiber material 4 is pressed at right angles to the longitudinal direction of the freight container 4 and also at right angles to the direction of pushing in 15. The fiber material tends to expand and back up after the pressing pressure has been released. In the exemplary embodiment according to FIG. 4, the backup forces are absorbed by the jacket of the freight container 4, so that the expansion of the pressed fiber material 5 in the longitudinal direction of the freight container 4 or in the direction of pushing in 15 is relatively small. The degree of filling can be correspondingly high as a result.

In the exemplary embodiment according to FIG. 3, the expansion of the pressed fiber material 5 is counteracted by suitable backup retainers 28. These may be movable and may be arranged on the inside of the jacket of the freight container 4 by means of suitable fastening devices.

In the exemplary embodiment according to FIG. 4, the front-side doors 23 of the freight container 4 are closed upon completion of the filling process. The doors 23 are preferably designed as sliding doors for this purpose. However, they may also be designed as hinged doors, and the freight container 4 and the filling and prepressing chamber 20 are moved apart to a certain extent. Suitable backup flaps 28 can ensure retention of the fiber material 5 during the closure of the doors 23 in this case as well.

Figure 5:
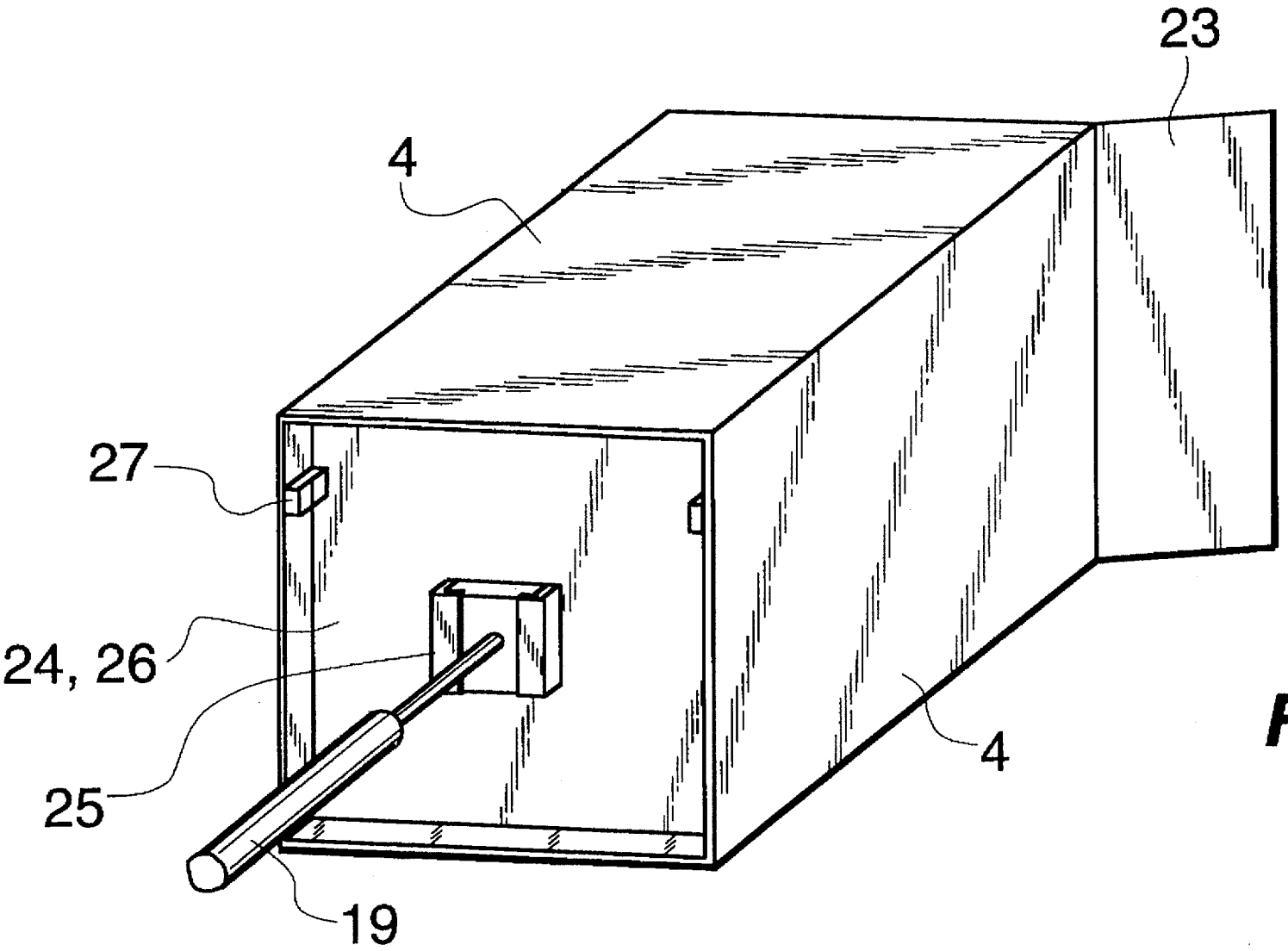
FIG. 5 is a perspective view of a freight container with a movable wall element as a pressing plate with a press ram.

FIG. 5 shows a perspective and partially cutaway representation of the freight container 4 with the above-described wall element 24. The support 25 for the press ram 19 is designed as, e.g. a rail guide, into which a connection plate can be inserted from the top. However, any other type of support or detachable fastening device may also be provided as an alternative. FIG. 5 also illustrates as an example the arrangement of a longitudinally directed guide 27 for the wall element 24.

The fiber material 5 was compacted during the filling process in the above-described exemplary embodiments. FIGS. 6 through 9 show a variant, in which the fiber material 5 is collected in a block-pressing device 21 outside the freight container 4, and it is compacted into a block of fibers 6. The dimensions of the block of fibers 6 correspond essentially to the internal dimensions of the freight container 4, and after the block has been prepared, it is transported as a whole into the freight container 4 by means of a conveying means 22.

The conveying means 22 may be part of the block-pressing device 21. In the exemplary embodiment shown, the conveying means 22 consists of two revolving belts, which form the upper side and the lower side of the block-pressing device 21 and are able to absorb corresponding transverse pressure forces. The front-side or end limitations of the block-pressing device 21 are formed by two vertical pressing plates 26, at least one of which can act as the wall element 24 of the freight container 4.

Figure 6:
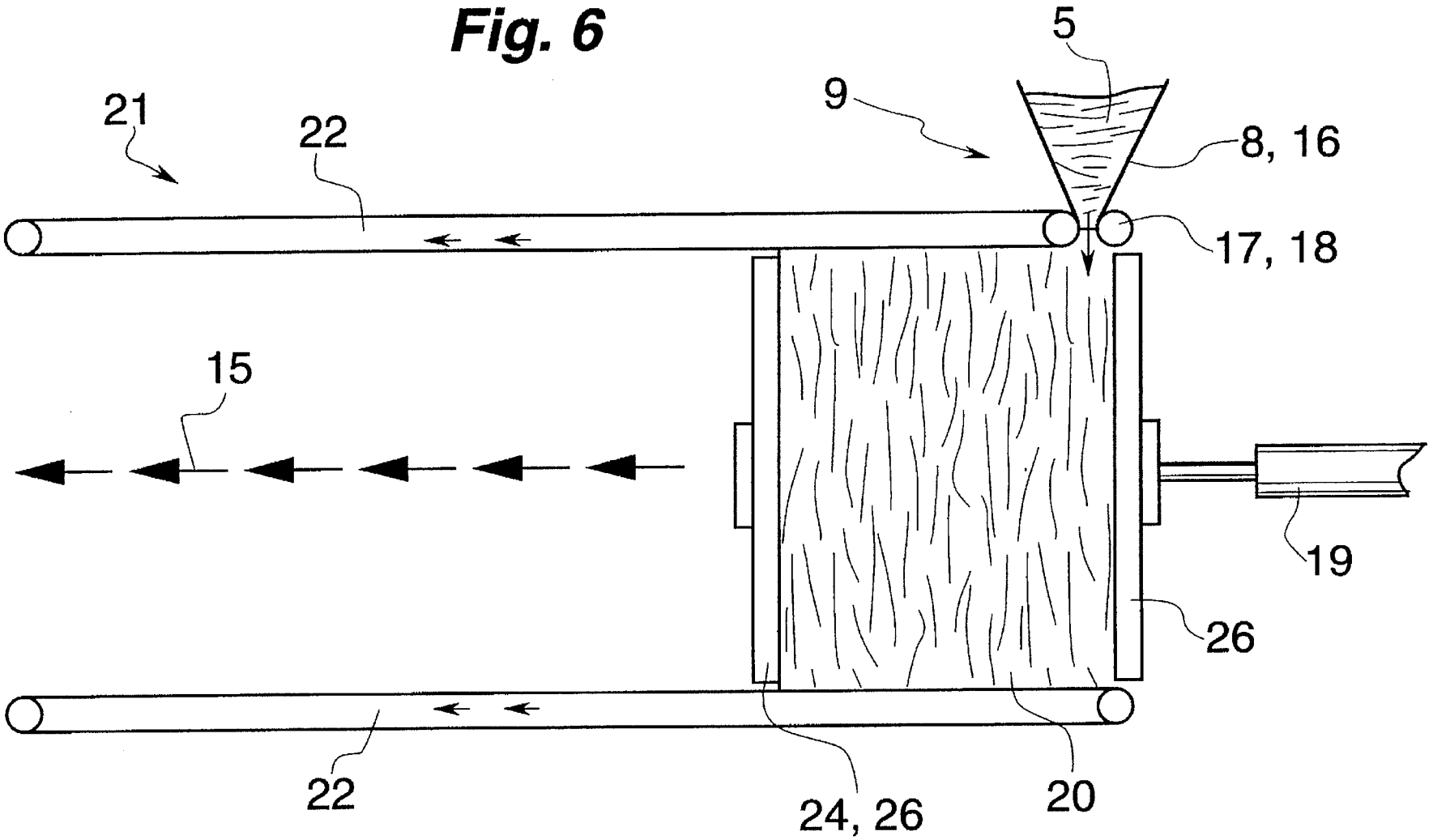
FIG. 6 is a schematic view of a freight container with a block pressing device for forming a block of fibers outside the freight container.
Figure 7:
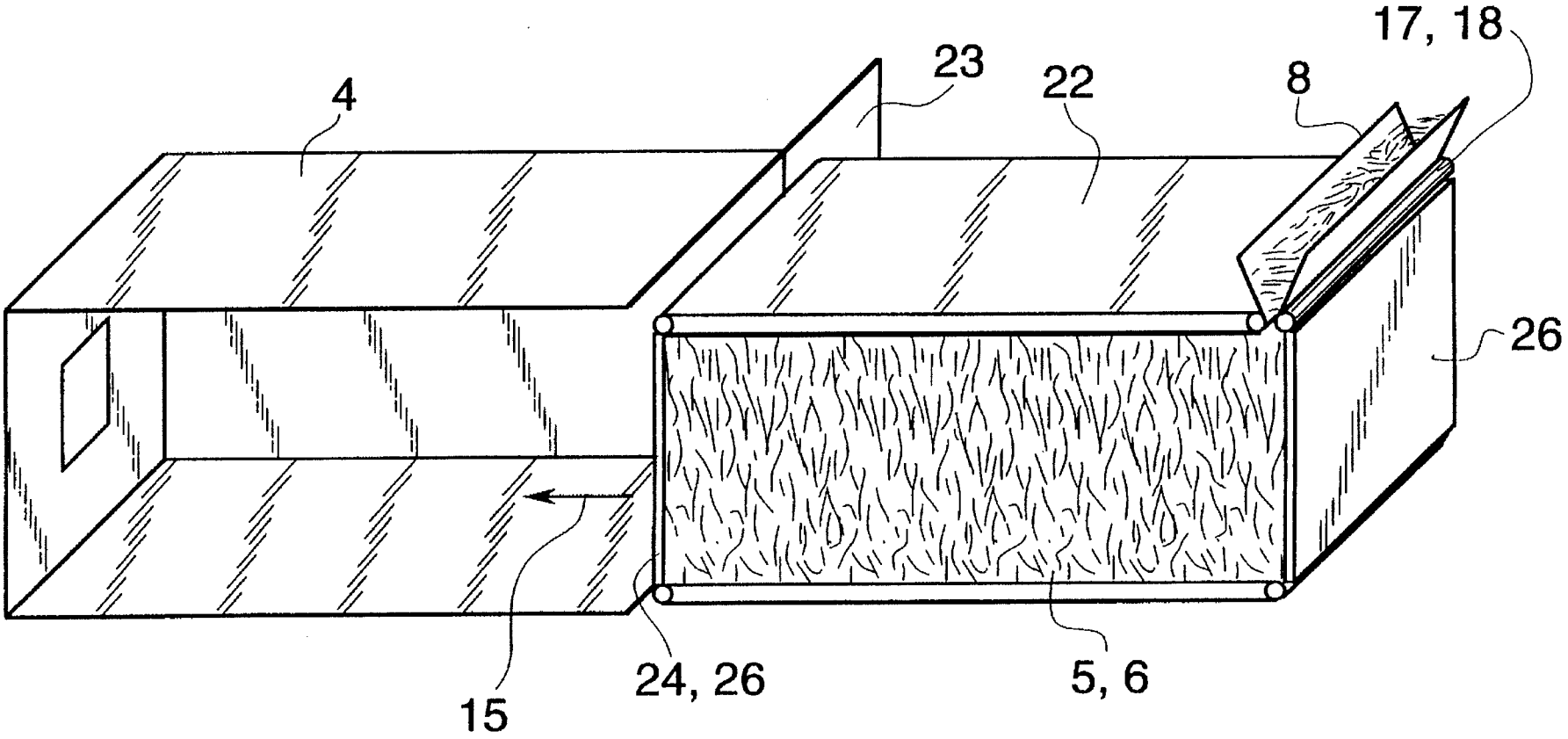
FIG. 7 shows a block of fibers prepared with the structure shown in FIG. 6 and which block is being moved into a freight container.

The fiber material 5 is also compacted in the direction of filling 13 in the exemplary embodiment according to FIGS. 6 and 7, similarly to FIG. 4. To do so, a pressing device 18, is arranged at the foot of the hopper 16 consists of conveying rollers which squeezes the fiber material 5 being fed in the roller gap 6 and conveys it in the downward direction under pressure.

After a partial batch has been filled in and compacted, the rear pressing plate 26 is moved forward by the suitable press ram 19 or another drive, and it pushes the partial batch onto the front pressing plate 26 or a partial batch formed before. The front pressing plate 26 is moved somewhat in the forward direction, so that space is again created for a new filling and compaction process after withdrawal of the rear pressing plate 26.

FIG. 7 shows the block of fibers 6, which was prepared gradually in the above-described manner, and which is then moved by the conveying means 22 into the freight container 4.

Various design possibilities are available for transfer. In the exemplary embodiment shown in FIGS. 8 and 9, the conveying means 22 is displaceable in the longitudinal direction. To load the freight container 4, it moves with the block of fibers 6 clamped in it into the freight container 4, and the two front-side or end pressing plates 26 are carried with it as well.

Figure 8:
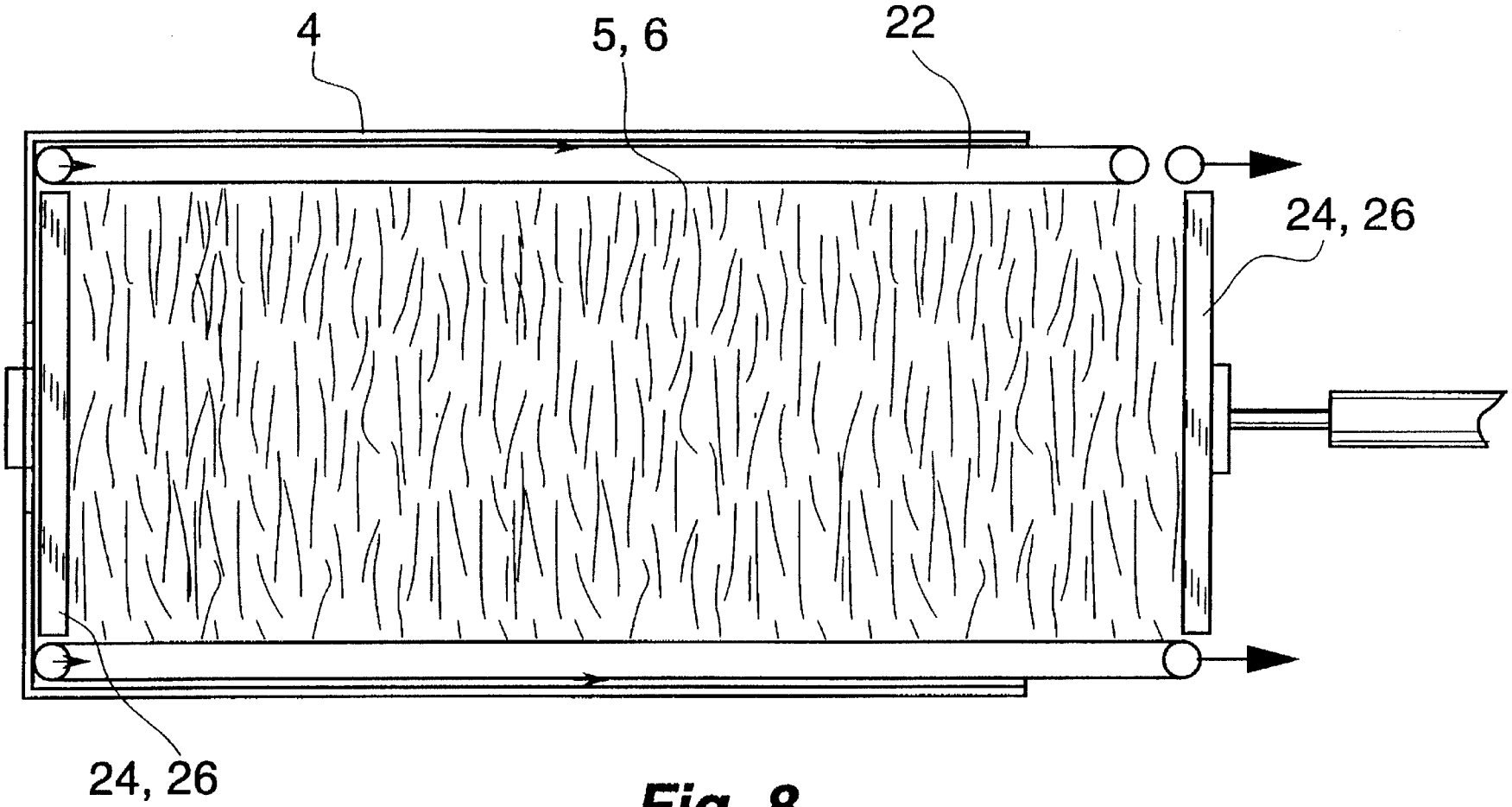
FIG. 8 is a schematic view showing the end position of the block in a freight container.
Figure 9:
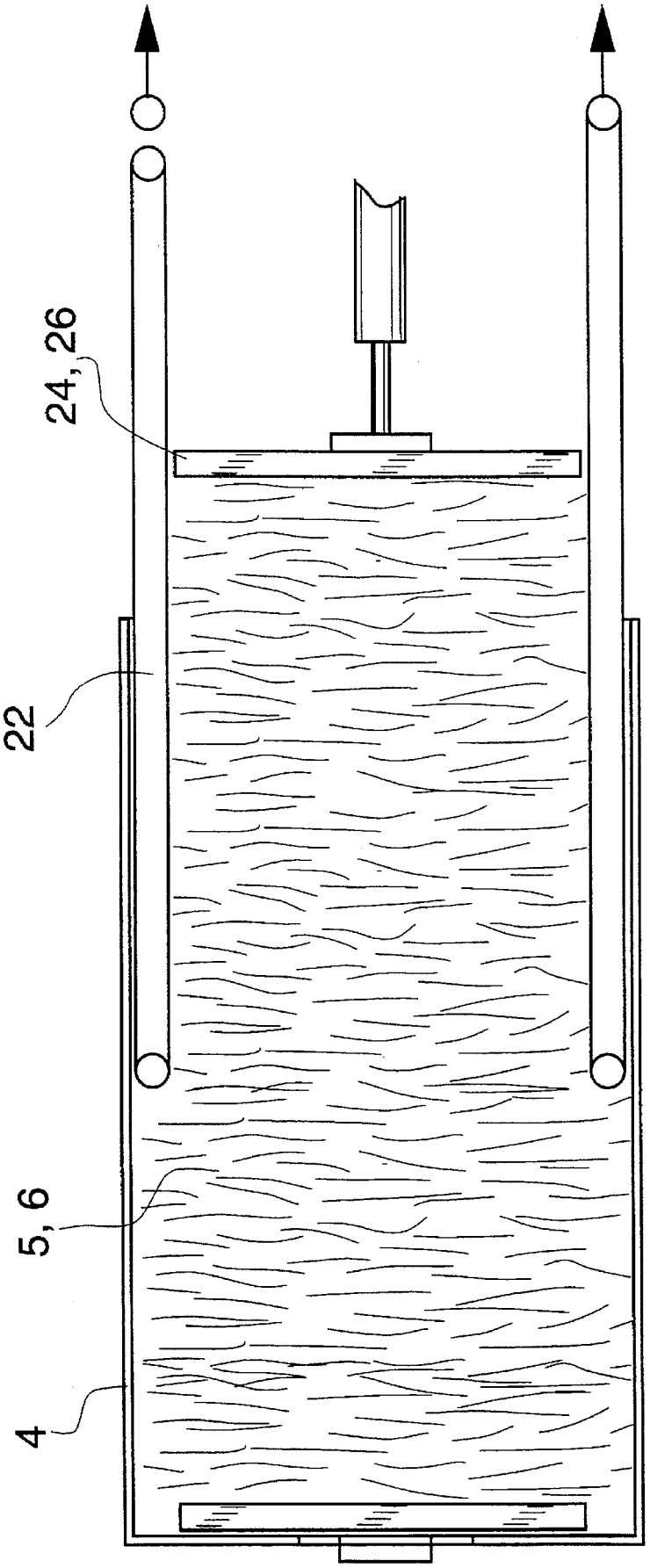
FIG. 9 is a schematic view showing the retraction of a conveying means as the block is disposed in a freight container.

FIG. 8 shows the end position in the freight container 4. The conveying means 22 is then withdrawn, and its two belts are also set into revolving movement at the same time, so that they roll off the block of fibers 6 in the direction of withdrawal. The block of fibers 6 can then expand somewhat and fill the entire interior space of the freight container 4. FIG. 9 shows this process and also illustrates the closed position of the wall element 24 at the front opening of the freight container 4.

As a modification of the exemplary embodiment shown, the block of fibers 6 may also be pushed out of the block-pressing device 21 and into the freight container 4 by a slide or the like.

Figure 12:
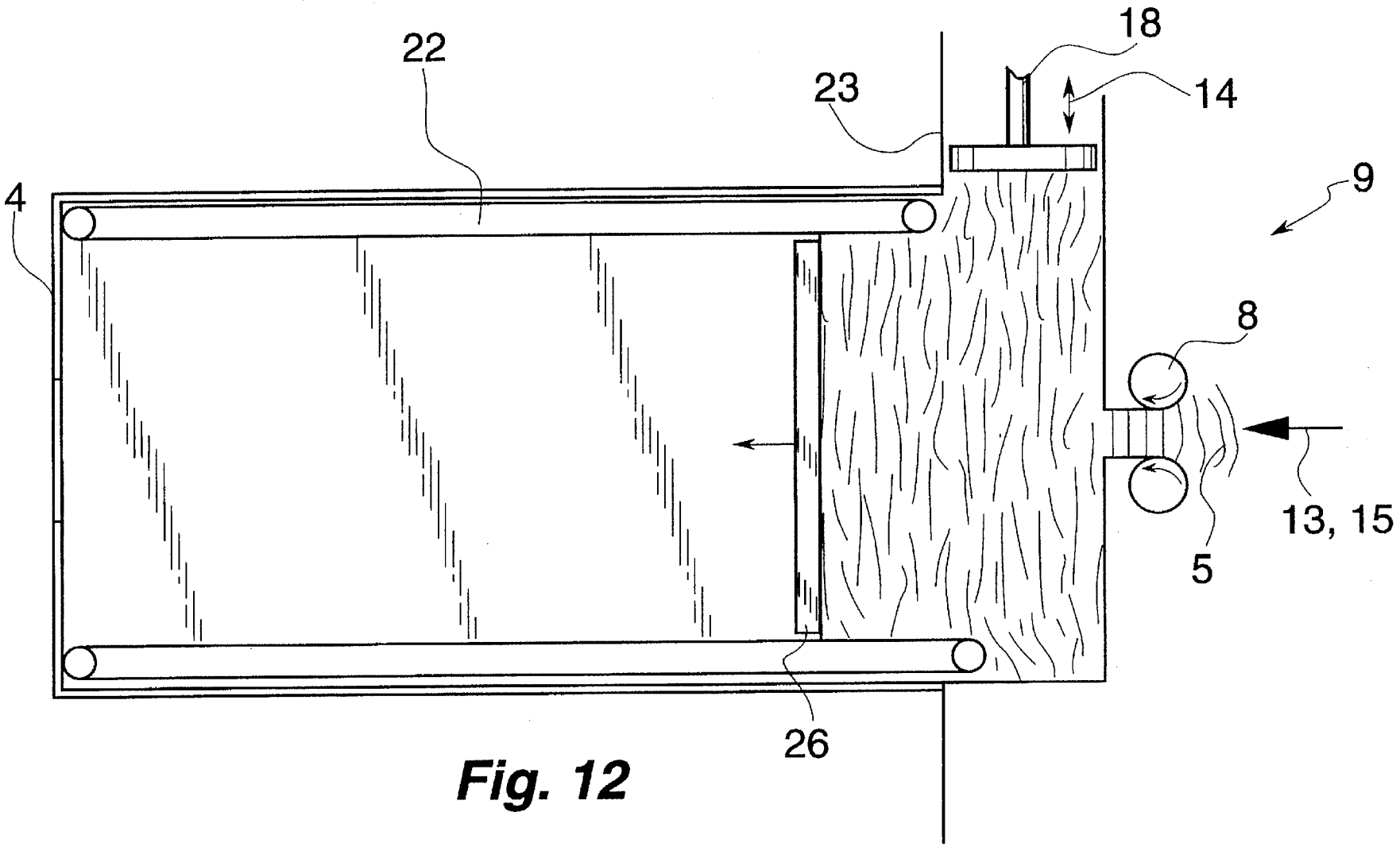
FIGS. 12 and 13 are schematic views showing a freight container with built-in conveying means during the filling and emptying respectively.

FIG. 12 shows another variant, in which an active loading and unloading device is arranged within the freight container 4. It consists of a conveying means 22 similar to that shown in FIGS. 6 through 9. However, it is arranged rigidly within the freight container 4 in FIG. 12, and the belts can be caused to perform revolving movements and can be driven. The pressing plate 26 is attached between the belts, and it can be moved back and forth in the freight container 4 by the belt drive. The belt drive may be arranged on the inside or on the outside.

The vertical pressing device 18 is arranged in the exemplary embodiment according to FIG. 12. The filling device 8 operates horizontally in this exemplary embodiment, and it is also used to compact and push the fiber material 5 into the freight container 4 at the same time. The pressing plate 26 gradually recedes until the freight container 4 is filled. The direction of conveying 13 and the direction of pushing-in 15 coincide in this example, while the direction of pressing 14 extends at right angles thereto.

Figure 10:
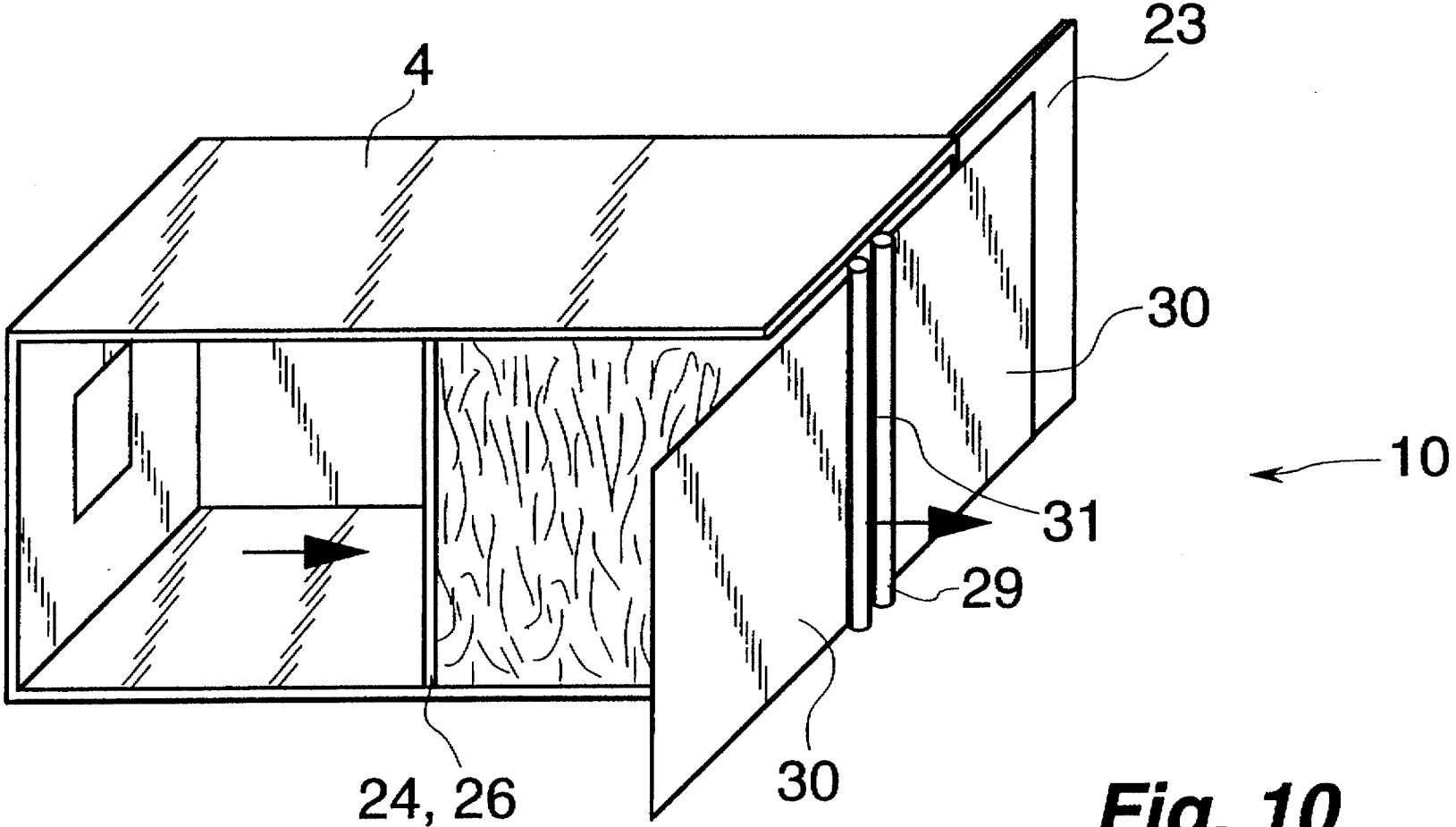
FIGS. 10 and 11 are a perspective view and a top view respectively of a freight container with an unloading device.
Figure 11:
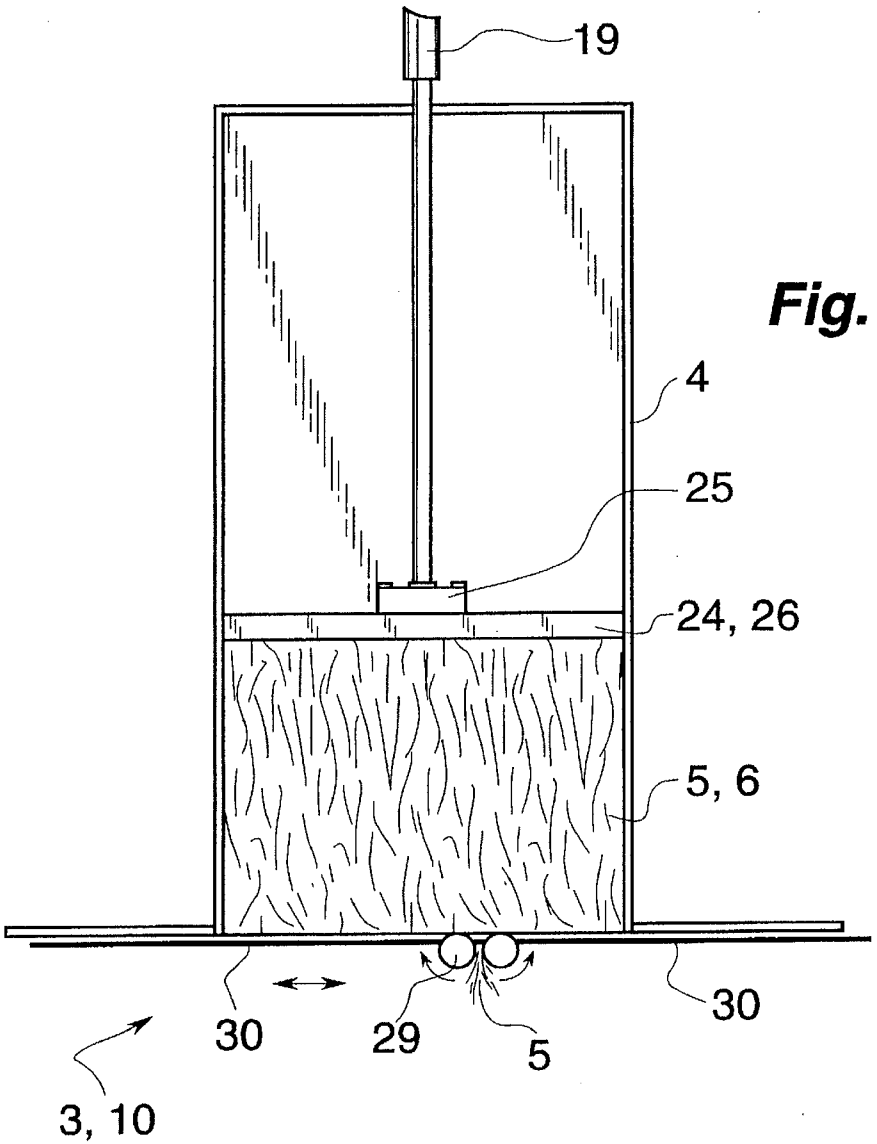
Figure 13:
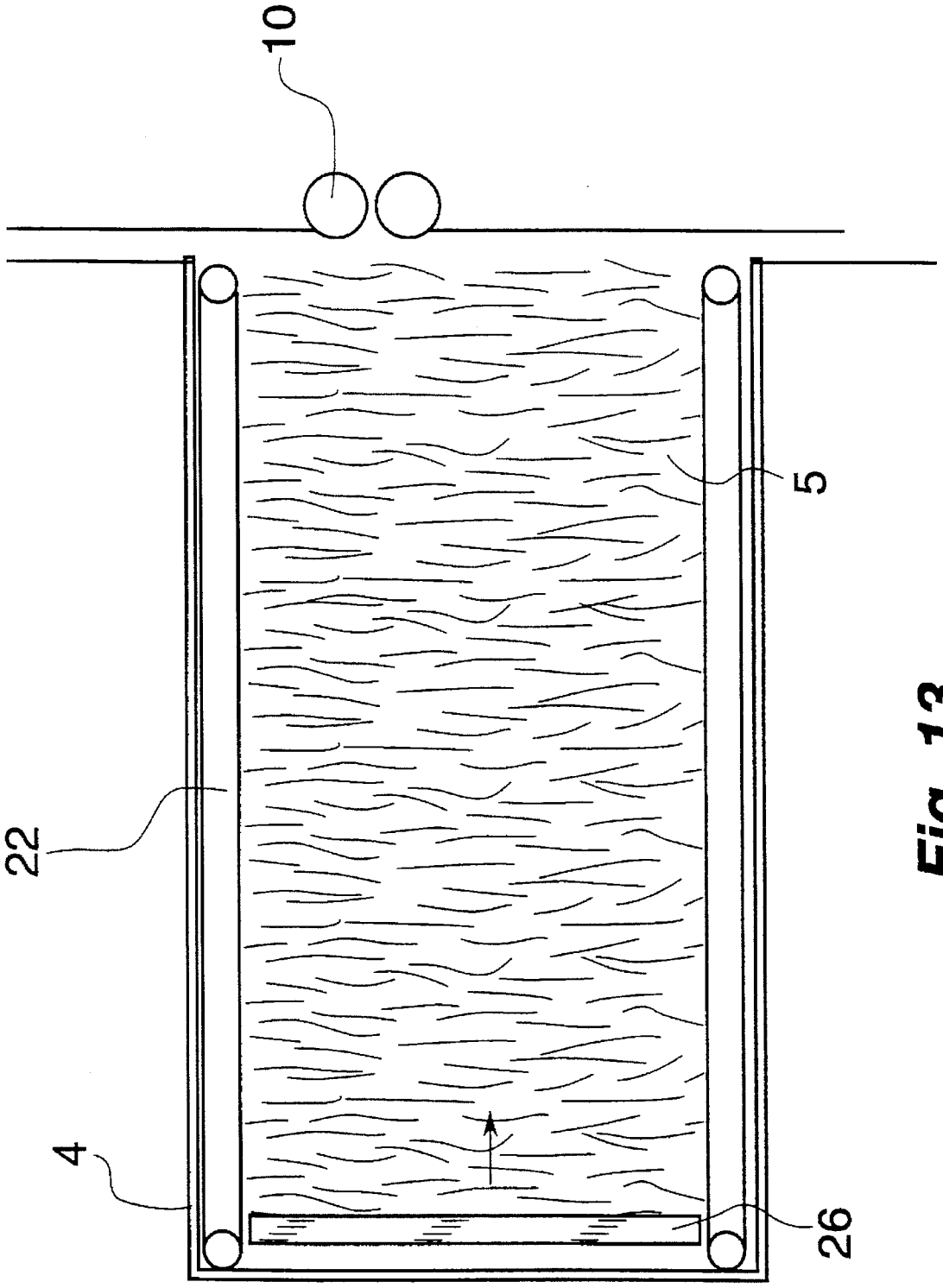

FIGS. 10, 11 and 13 show variants for unloading the freight container 4. The unloading device 10, arranged in the further processing station 3, consists, in the exemplary embodiment shown, of a fiber mill 29, which is positioned at the open front side of the freight container 4 and has two milling and conveying rollers. The rollers are joined on the side by cover plates 30, which leave open only a narrow slot 31 between them for the milling and conveying rollers. The milling roller 29 moves to and fro in front of the container opening and removes the pressed fiber material 5 by milling. The cover plates 30 prevent uncontrolled lateral discharge of the fiber material 5.

The block of fibers 6 is pressed out of the freight container 4 from the opposite front side during the removal of the fiber material 5. To do so, the front-side wall element 24, which again acts as the pressing plate 26, is pushed forward by the suitable press ram 19 or another drive in the exemplary embodiment according to FIGS. 10 and 11. In the exemplary embodiment according to FIG. 13, the pressing plate 26 is moved toward the unloading device 10 by the revolving belts of the conveying means 22.

Many variants of the design of the individual devices, their association and their directions of action are possible for the exemplary embodiments described. As is illustrated in FIG. 1, it is also possible to leave the freight container 4 on the transport vehicle 7 and to load or unload it in that position. Further, various freight containers are usable according to the invention. However, the term freight container as used herein relates to large containers for rail or ship transport an most especially, containers used with trucks for long transport such as those having standard external dimensions, such as a standard container with a length of 20' or 40'.

While specific embodiments of the invention have been shown and described in detail to illustrate the application of the principles of the invention, it will be understood that the invention may be embodied otherwise without departing from such principles.

What is claimed is:

1. Process for packaging and supplying fiber material, comprising the steps of: filling the fiber material into a closable freight container, compacting the fiber material, one of before or during filling; shipping compacted fiber material in the freight container; and subjecting the fibers to further processing after shipping.

2. Process in accordance with claim 1, wherein: the fiber material is filled into the freight container as a collective load and without additional baling and without hooping.

3. Process in accordance with claim 1, further comprising the steps of: gradually removing the compacted fiber material from the opened freight container with an unloading device; and feeding the unloaded fiber material directly into a further processing device.

4. Process in accordance with claim 1, wherein: the fiber material is compacted during filling into the freight container.

5. Process in accordance with claim 1, wherein: the fiber material is compacted prior to being filled into the freight container.

6. Process in accordance with claim 5, wherein: the fiber material is collected outside the freight container and is pressed into a shape corresponding to the interior space of the container, after which it is introduced as a block of fibers into the freight container.

7. Process in accordance with claim 1, wherein: the fiber material is compacted in a direction of pressing, the direction of pressing extending at right angles to a direction of pushing the fiber material into the freight container.

8. Process in accordance with claim 1, wherein: the fiber material is compacted by means of a wall element of the freight container.

9. Process in accordance with claim 1, wherein: the freight container is loaded onto a transport vehicle at a filling station.

10. Process in accordance with claim 1, wherein: the freight container is unloaded from a transport vehicle at a further processing station.

11. A device for packaging fiber material, the apparatus comprising:

a closable freight container having fastening element means designed to be repetitively connectable to and disconnected from a transport vehicle means;

compaction means designed to be repetitively connectable to and disconnectable from said freight container and for compacting the fiber material into a volume insertable into said closable freight container;

filling means designed to be repetitively connectable to and disconnectable from said freight container for filling said closable freight container with the fiber material to have the fiber material directly in contact with said freight container, said freight container blocking expansion of the fiber material.

12. Device in accordance with claim 11, further comprising: an unloading device for the fiber material, which is designed to be repetitively connectable to the freight container; and a further processing station, the unloading device being arranged at the further processing station.

13. Device in accordance with claim 11, wherein: the compacting means includes a pressing device sized to be insertable into the closable freight container.

14. Device in accordance with claim 11, wherein: the compacting means includes block-pressing, arranged outside the freight container, for forming blocks of fibers and conveying means for transporting blocks of fibers into the freight container.

15. Device in accordance with claim 13, wherein: the filling means has a prepressing device.

16. Device in accordance with claim 13, further comprising: a filling and prepressing chamber.

17. Device in accordance with claim 13, wherein: a direction of filling and a direction of pressing are at right angles to one another.

18. Device in accordance with claim 16, wherein the filling means and the compacting means operate in the same direction of action and at right angles to a direction of pushing into the freight container.

19. Device in accordance with claim 11, wherein: the freight container has one or more doors on one front side.

20. Device in accordance with claim 11, wherein: the freight container has at least one movable wall element designed as a pressing plate.

21. Device in accordance with claim 20, wherein: the wall element has a support for a press ram.

22. Device in accordance with claim 11, wherein: the freight container has one or more backup retainers for the fiber material.

23. Device in accordance with claim 11, wherein: the freight container is designed, in terms of its external dimensions, as a standard container with a length of 20' or 40'.

24. Device in accordance with claim 12, wherein: the unloading device has a movable fiber mill and laterally adjoining cover plates.

25. Device in accordance with claim 11, further comprising: a loading and positioning device for the freight container, arranged at a filling station and/or at a further processing station.

26. A device in accordance with claim 11, wherein:

said filling means includes receiving the compacted fiber material from said compaction means and fills said closable freight container with the compacted fiber material;

said closable freight container is movable between two locations and is designed to be filled and emptied repetitively.

27. A device in accordance with claim 11, wherein:

said closable freight container includes an end wall which is movable inside said closable freight container and connectable to said filling means to push the fiber material into said closable freight container.

28. A process for packaging and supplying fiber material, the process comprising the steps of:

providing a closable freight container at a filling station;

compacting the fiber material into a volume insertable into said closable freight container;

filling said closable freight container with the fiber material to have said freight container directly in contact with the fiber material and block the fiber material from expanding;

closing said freight container at said filling station;

transporting said freight container on a vehicle to a processing station;

directly removing the fiber material from said freight container at said processing station.

29. Process in accordance with claim 28, wherein:

said closable freight container includes an end wall which is movable inside said closable freight container;

said compacting includes pressing the fiber material into a prechamber adjacent an open end of said freight container, said end wall defining one side of said prechamber;

said filling includes filling said prechamber with the fiber material and moving said end wall in a direction substantially perpendicular to a direction of said pressing in order to push the fiber material into said closable freight container;

said transporting includes loading said freight container onto said vehicle from said filling station, attaching said freight container to a top of said vehicle, and unloading said freight container from said top of said vehicle to said processing station.

* * * * *